United States Patent [19]

Tanaka

[11] Patent Number: 4,998,493

[45] Date of Patent: Mar. 12, 1991

[54] EDGE TRACING SEWING MACHINE

[75] Inventor: Takafumi Tanaka, Nagoya, Japan

[73] Assignee: Brother Kogyo Kabushiki Kaisha, Japan

[21] Appl. No.: 527,878

[22] Filed: May 24, 1990

[30] Foreign Application Priority Data

Jul. 25, 1989 [JP] Japan ..... 1-193210

[51] Int. Cl.[5] ..... D05B 3/02

[52] U.S. Cl. ..... 112/453; 112/153; 112/275; 112/306; 112/314

[58] Field of Search ..... 112/453, 153, 456, 121.11, 112/121.12, 306, 314, 315, 275

[56] References Cited

U.S. PATENT DOCUMENTS

| | | | |
|---|---|---|---|
| 4,722,288 | 2/1988 | Nomura et al. | 112/275 X |
| 4,736,699 | 4/1988 | Dobner et al. | 112/275 X |
| 4,869,189 | 9/1989 | Horie et al. | 112/453 |

*Primary Examiner*—Peter Nerbun

*Attorney, Agent, or Firm*—Oliff & Berridge

[57] ABSTRACT

An edge tracing sewing machine includes a reciprocable needle bar having a needle at a lower end, a forward feed driving device for feeding a work fabric in a sewing direction, a lateral feed driving device for feeding the work fabric in a lateral direction perpendicular to the sewing direction, a tracing width setting device for setting a tracing width from the edge of the work fabric to the needle in the lateral direction, a fabric-edge sensor movable in the lateral direction for detecting an edge of the work fabric, a fabric-edge position detector for detecting a position of the fabric-edge sensor, and a control device. The control device moves the fabric-edge sensor in the lateral direction to make the fabric-edge sensor follow the edge of the work fabric. The control device controls the lateral feed driving device based on the tracing width set by the tracing width setting device and the position of the fabric-edge sensor detected by the fabric-edge position detector. The control device stops a reciprocation of the needle bar and forward and lateral feeding operations of the forward and lateral feed driving devices when the fabric-edge sensor does not detect the edge of the work fabric.

11 Claims, 12 Drawing Sheets

EDGE TRACING SEWING MACHINE

BACKGROUND OF THE INVENTION

1. Field of the Invention

This invention relates to sewing and specifically to a sewing machine having a fabric-edge tracing function.

2. Description of the Prior Art

Fabric-edge tracing sewing machines are already known wherein stitches are formed along a line spaced by a predetermined distance from an edge of a workpiece or work fabric.

One of such fabric-edge tracing sewing machines is disclosed, for example, in Japanese Patent Laid-Open No. 221389/1987 filed by the assignee of the present patent application, wherein a fabric-edge sensor is moved by a stepping motor in a lateral direction so that the amount of light received by a light receiving element provided on the fabric-edge sensor may be equal to a preset value, that is, a value which is presented when an edge of a work fabric is detected, and a needle bar is swung to a needle location which is determined in accordance with a preset tracing width and a position signal which is generated from a fabric-edge position detector in response to movement of the fabric-edge sensor.

Another tracing sewing machine has been put into practical use wherein such a fabric-edge sensor as described above is provided on a needle bar and the needle bar is swung by means of a needle bar swinging stepping motor so that the amount of light received by the light receiving element of the fabric-edge sensor may present a preset value when a needle is positioned above a face of a bed.

Stepping motors are used for fabric edge sensor drives and for needle bar swinging drives because they do not need the relatively complex positional control systems required for use of DC motors in such applications. Thus, stepping motors are used because they are more space and cost effective. However, stepping motors have a slow response time compared with DC motors.

In the tracing sewing machine disclosed in Japanese Patent Laid-Open No. 221389/1987 mentioned hereinabove, when the work fabric is moved by a great distance in a lateral direction while tracing sewing is being performed, or when the position of an edge of the work fabric varies to a great extent in accordance with a profile of the work fabric, or else when the work fabric is turned in order to perform tracing sewing at a corner of the work fabric or in a like case, the relative position between the fabric-edge sensor and the edge of the work fabric varies to a great extent, which increases the period of time required for the movement of the fabric-edge sensor. Accordingly, the fabric-edge sensor may fail to detect the edge of the work fabric accurately by a next needle position calculation timing, and since a needle location is determined in accordance with artificial needle position data which is based on current data during movement of the fabric-edge sensor and needle position data one stitch cycle ago to perform tracing sewing, there is a problem that the quality in tracing sewing is deteriorated.

Further, in the tracing sewing machine which provides the fabric-edge sensor on the needle bar, since an edge of a work fabric is detected only when the needle is positioned above the face of the bed, the period permitting the movement of the fabric-edge sensor is further decreased, and consequently, there is a problem that the quality of tracing sewing is further deteriorated.

SUMMARY OF THE INVENTION

It is an object of the present invention to provide a fabric-edge tracing sewing machine which can be improved in accuracy in detection of an edge of a work fabric to improve the quality of tracing sewing.

The above object can be achieved, according to the present invention, by a sewing machine which comprises:

a reciprocable needle bar having a needle at a lower end thereof; feeding means for feeding a workpiece in a sewing direction; relative position changing means for changing relative position between the needle and the workpiece in a lateral direction perpendicular to the sewing direction; tracing width setting means for setting a tracing width from the edge of the workpiece to the needle in the lateral direction; edge detecting means for detecting the edge of the workpiece in the lateral direction relative position control means for controlling the relative position changing means based on the tracing width set by the tracing width setting means and the detection of the edge of the workpiece by the edge detecting means; and interrupting means for stopping a reciprocation of the needle bar and a feeding operation of the feeding means while the edge detection means does not detect the edge of the workpiece.

BRIEF DESCRIPTION OF THE DRAWINGS

A preferred embodiment of the present invention will be described in detail with reference to the following figures wherein.

DETAILED DESCRIPTION OF THE PREFERRED EMBODIMENT

There will now be described a preferred embodiment of the present invention with reference to the drawings, in which the present invention is applied to an electronically controlled zigzag sewing machine.

Figure 1:
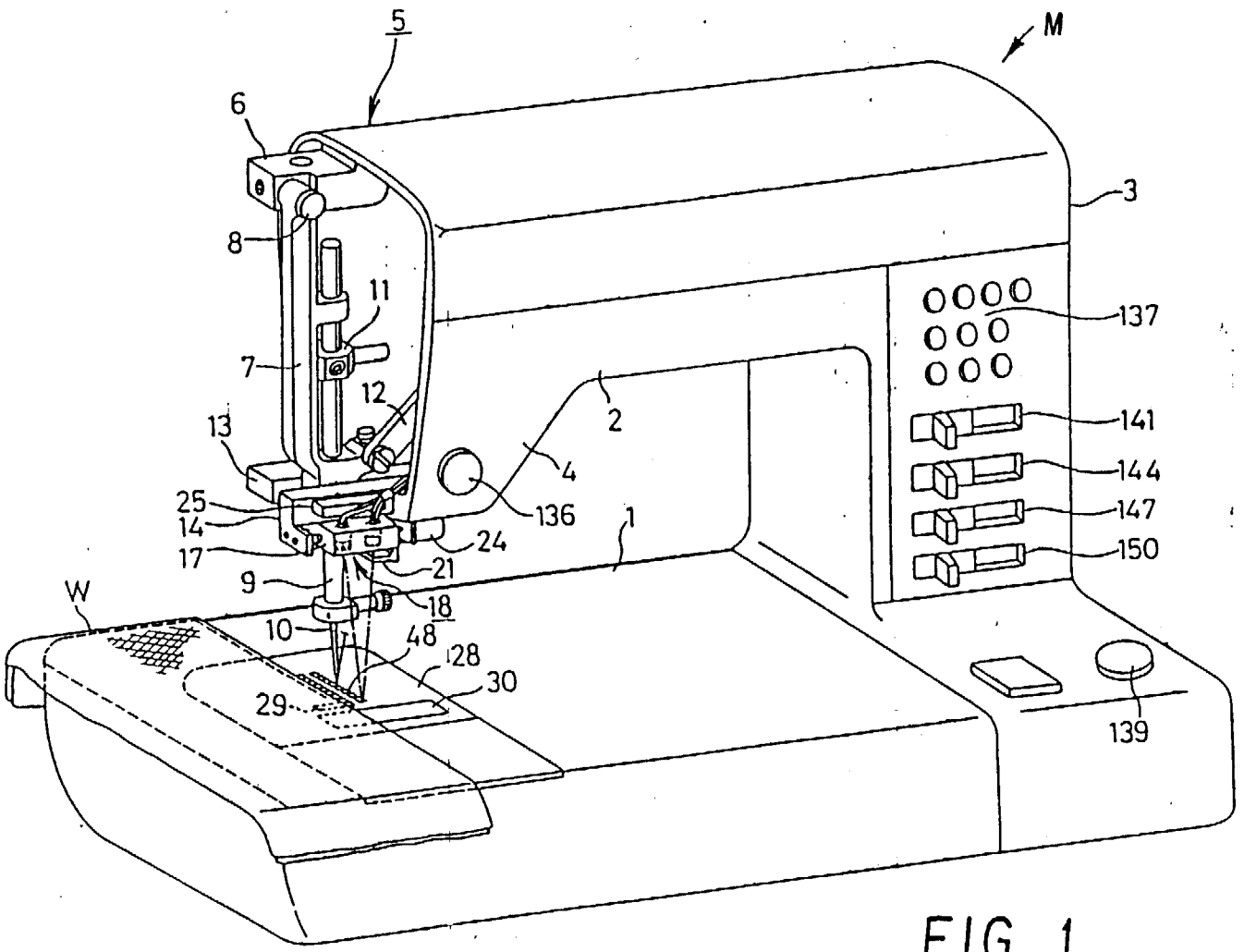
FIG. 1 is a perspective view of an internal mechanism of a head section of an edge tracing sewing machine showing a preferred embodiment of the present invention.
Figure 3:
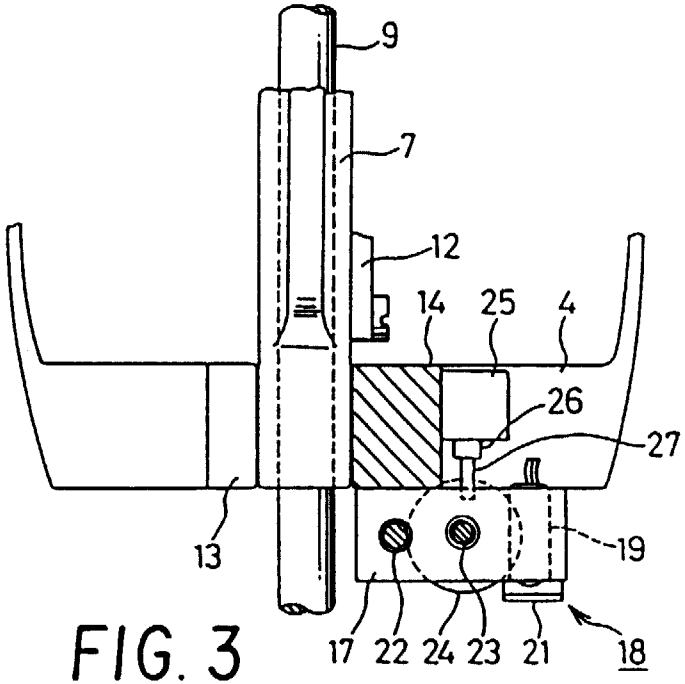
FIG. 3 is a sectional view taken along line III—III of FIG. 2.
Figure 2:
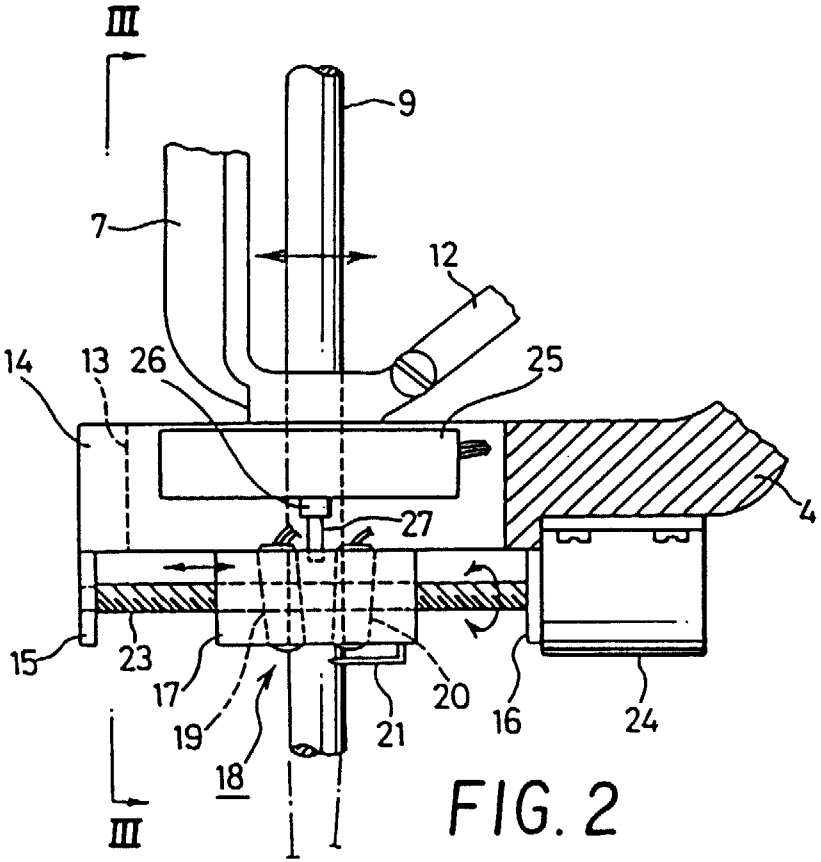
FIG. 2 is a vertical sectional view of part of the head section shown in FIG. 1.

Referring to FIGS. 1 to 3, a device for vertically driving a needle bar 9 and a device for swingably driving the needle bar 9 are incorporated in an arm 2 of a sewing machine These devices are similar to those of a usual zigzag sewing machine, and a general construction thereof will now be described. A needle bar support 7 is swingably supported at its upper end by a pivot pin 8 to a supporting portion 6 fixed to a head 4. The needle bar 9 is vertically movably supported to the needle bar support 7, and a needle 10 is attached to the lower end of the needle bar 9. The needle bar 9 is connected through a needle bar connecting stud 11, an arm shaft 44, etc. to a main motor 155 (see FIG. 12). The needle bar 9 and the needle 10 are vertically reciprocated by rotating the main motor 155. The lower end portion of the needle bar support 7 is connected through a connecting rod 12 to a stepping motor 135 for swinging a needle bar (see FIG. 12). The needle 10 is swung through the needle bar support 7 and the needle bar 9 by driving the stepping motor 135.

A fabric-edge detecting device will now be described. Guide members 13 and 14 fixed to the head 4 are located just behind and before the lower end portion of the needle bar support 7, respectively, in such a manner as to extend horizontally leftwardly from the head 4. That is, the lower end portion of the needle bar support 7 is held and guided between the guide members 13 and 14. A fabric-edge sensor 18 includes a light emitter 19 for emitting infrared rays and a photoelectric cell 20 for receiving a reflected light of the infrared rays. The light emitter 19 and the photoelectric cell 20 are mounted in a supporting member 17 in such a manner as to be inclined at a predetermined angle in symmetrical relationship in a horizontal direction as viewed in FIG. 2. An optical filter 21 permitting passage of the infrared rays only is fixed to the supporting member 17 at a position just below the photoelectric cell 20, behind the light emitter 19 and the photoelectric cell 20, a guide shaft 22 extending in the horizontal direction as viewed in FIG. 2 is inserted through the supporting member 17, and a feed screw 23 extending in the horizontal direction parallel to the guide shaft 22 is threadedly engaged in the supporting member 17. The left ends of the guide shaft 22 and the feed screw 23 are rotatably supported on a mounting member 15 fixed to the guide member 14, while the right ends of the guide shaft 22 and the feed screw 23 are also rotatably supported to a mounting member 16 fixed to the guide member 14. The right end of the feed screw 23 is fixed to a driving shaft of a fabric-edge detecting motor 24 mounted to the head 4. Advantageously, motor 24 is a stepping motor. Accordingly, when the feed screw 23 is rotated by the motor 24, the supporting member 17 is moved right and left between both the mounting members 15 and 16.

A fabric-edge position detector 25 may be a variable resistor of the sliding type and is securely mounted on the guide member 14 just above the supporting member 17. The fabric-edge position detector 25 has a sliding member 26 connected to a connecting projection 27 which extends upwardly from the supporting member 17. Accordingly, the fabric-edge position detector 25 outputs a fabric-edge position voltage Vd corresponding to a distance between a current position and a right limit position (right end position of the detection range) of the fabric-edge sensor 18 provided by movement of the slider 26 upon leftward or rightward movement of the supporting member 17.

A throat plate 28 is disposed on a bed 1 of the sewing machine M and has a laterally elongated needle hole 29 formed therein such that the needle 10 can pass through the needle hole 29. The throat plate 28 has a rectangular reflecting face 30 formed at a portion thereof opposing to the supporting member 17. Infrared rays emitted from the light emitter 19 are deflected by the reflecting face 30 of the throat plate 28 and then received by the photoelectric cell 20. The photoelectric cell 20 outputs a detection voltage Vs in accordance with an amount of infrared rays reflected by the reflecting face 30 other than a portion which is covered with the work fabric W.

A starting/stopping button 136 for starting or stopping sewing operation is provided on the head 4. Various elements are provided on a column part 3 of the machine frame 5 and include a pattern select switch 137 in the form of a ten-key switch for selecting a desired sewing pattern, a feed pitch adjusting knob 141 for adjusting a feed pitch of the work fabric W, a needle swing amount adjusting knob 144 for adjusting an amount of swinging motion of the sewing needle 10, a speed adjusting knob 147 for setting a sewing speed, a tracing width setting knob 150 for setting a tracing width between the edge of the work fabric W and a line of stitches to be formed on the work fabric W, and a tracing button 139 for the selection of tracing sewing.

Figure 6:
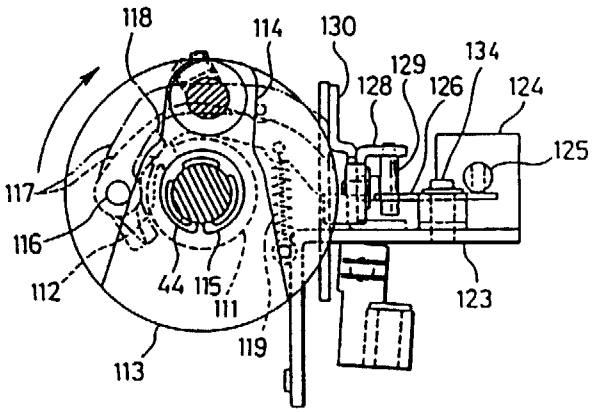
FIG. 6 is a sectional view taken along line VI—VI of FIG. 5.

There will now be described a needle bar clutch mechanism 110 for temporarily stopping the vertical reciprocation of the needle bar 9, with reference to FIGS. 4 to 6.

A cylindrical set collar 111 is mounted on the arm shaft 44 extending longitudinally in the arm 2 and adapted to be rotated by the main motor 155, and is fixed by a screw in the vicinity of the left end portion of the arm shaft 44. An outer circumference of the set collar 111 is partially formed with a recess 112 extending along an axial full length of the set collar 111. A crank disc 113 is rotatably mounted on the left end portion of the set collar 111. A thread take-up crank 114 is rotatably mounted on the arm shaft 44 in such a manner as to abut against the left end surfaces of the set collar 111 and the crank disc 113. The crank disc 113 is fixed to the thread take-up crank 114, and the thread take-up crank 114 is prevented from disengaging from the arm shaft 44 by means of a stop ring 115 mounted on the left end portion of the arm shaft 44.

A curved clutch plate 117 is pivotably supported at its base portion to the right side surface of the crank disc 113 by a pin 116 fixed to the crank disc 113 in such a manner as to be rotatable in a plane perpendicular to the arm shaft 44. The clutch plate 117 is formed near its base portion with a projection 118 engageable with the recess 112 of the set collar 111. The clutch plate 117 is biased by a tension spring 119 in a direction such that the projection 118 comes into engagement with the recess 112. Accordingly, when the recess 112 is brought into engagement with the projection 118 by the rotation of the arm shaft 44, the clutch plate 117 is rotated to thereby rotate the crank disc 113 and the thread take-up crank 114. A needle bar crank 120 is connected to a crank pin 121 mounted on the thread take-up crank 114. Reference numeral 122 designates a thread take-up lever.

A solenoid 124 elongated in the longitudinal direction of the arm shaft 44 is fixed on a mounting plate 123 fixed to the machine frame 5. An output shaft 125 of the solenoid 124 is connected to the base portion of a rotating lever 126 rotatably mounted through a pin 134 to the mounting plate 123. A forked portion 127 formed at the end portion of the rotating lever 126 is engaged with a pin 129 fixed to a slide plate 128. A pair of pins 131 are mounted on a supporting plate 130 fixed to the mounting plate 123, and the pins 131 are engaged with a pair of elongated holes 132 formed through the slide plate 128. Thus, the vertical and rotational movements of the slide plate 128 are restricted by the pins 131, and only the horizontal movement of the slide plate 128 along the supporting plate 130 is permitted. Further, a tension spring 133 is connected between the slide plate 128 and the supporting plate 130 to normally bias the slide plate 128 rightward.

Figure 4:
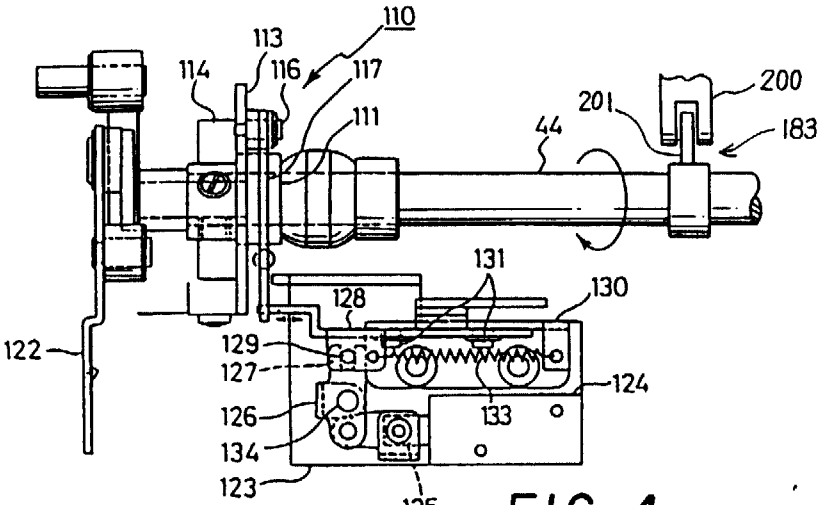
FIG. 4 is a top plan view of a needle bar clutch mechanism of the sewing machine of FIG. 1.
Figure 5:
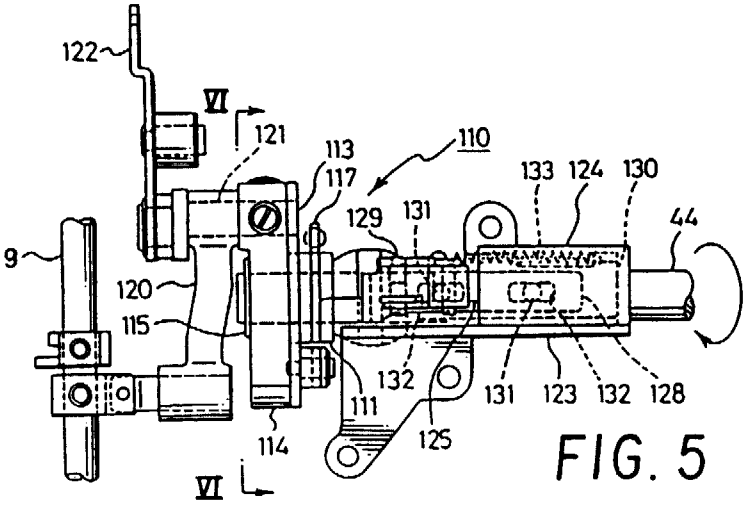
FIG. 5 is a front elevational view of the needle bar clutch mechanism of FIG. 4.

When the solenoid 124 is driven during rotation of the arm shaft 44, the rotating lever 126 is rotated counterclockwise as viewed in FIG. 4 against a biasing force of the spring 133 The counterclockwise rotation of the rotating lever 126 causes leftward movement of the slide plate 128 to an operative position where the end portion of the clutch plate 117 abuts against the end portion of the slide plate 128 when the needle bar 9 is in a substantially uppermost position. Thereafter, the clutch plate 117 is rotated to an inoperative position as shown by a two-dot chain line in FIG. 6 by the rotation of the arm shaft 44. As a result, the engagement of the projection 118 with the recess 112 is released, thereby maintaining the needle bar 9 in the uppermost position irrespective of the rotation of the arm shaft 44. When the solenoid 124 is de-excited, the slide plate 128 is returned to its original or inoperative position by the biasing force of the spring 133. Then, when the arm shaft 44 comes to a phase of substantially zero degree, the clutch plate 117 is returned to its original or operative position by the biasing force of the spring 119 to thereby engage the projection 118 with the recess 112 again, thus restarting the vertical reciprocation of the needle bar 9.

There will now be described a vertical feed driving device and a forward feed driving device provided in the bed 1 with reference to FIGS. 7 to 11.

A planar base plate 40 extending in a longitudinal direction of the bed 1 is disposed in the vicinity of the bottom portion of the bed 1, and is fixed to the machine frame 5. A lower shaft 41 extending in the longitudinal direction of the bed 1 is located at the substantially central position of the bed 1 with respect to the transverse direction thereof and is rotatably supported by a plurality of bearings 42 fixed to the base plate 40 and extending upwardly. A pulley 43 is mounted on the right end portion of the lower shaft 41. A timing belt 45 is wrapped around the pulley 43 and another pulley (not shown) fixed to the arm shaft 44, so that the lower shaft 41 is rotated in synchronism with the arm shaft 44 through the timing belt 45 and the pulley 43 by the rotation of the arm shaft 44.

A channel member 46 having a substantially U-shaped configuration as viewed in elevation and extending in the transverse direction of the bed 1 is fixed to the base plate 40 in the vicinity of the right end portion thereof. A left one of opposite side walls 47 of the channel member 46 projects frontward, and a forward feed stepping motor 40 for moving the feed dog 48 forwardly and reversely is mounted on the left side wall 47. A fixed shaft 50 is disposed in the vicinity of the front end of the base plate 40, and extends from the substantially central position of the base plate 40 in the longitudinal direction thereof to the channel member 46. A left end portion of the fixed shaft 50 is fixed by a screw 52 to a support 51 fixed to the base plate 40, and a right end portion of the fixed shaft 50 is fixed to the right and left side walls 47 of the channel member 46. A first swinging member 53 is formed at its lower portion with a pair of pivotal portions 54, and the fixed shaft 50 is inserted through the pivotal portions 54. Thus, the first swinging member 53 is swingably supported at its pivotal portions 54 to the fixed shaft 50. The first swinging member 53 is further formed at its upper portion with a pair of supporting portions 56, and a shaft 55 disposed in parallel to the fixed shaft 50 is fixed at its opposite ends to the supporting portions 56.

Figure 11:
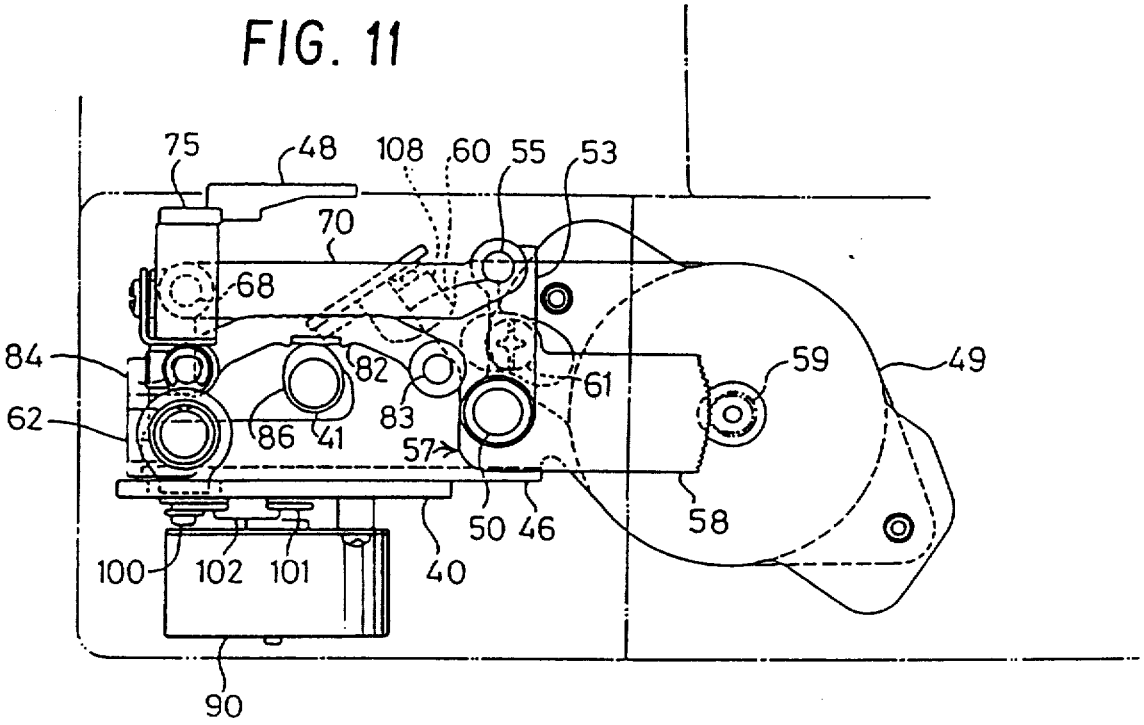
FIG. 11 is a left-hand side elevational view of the internal mechanism shown in FIG. 7.

As shown in FIG. 11, a swinging/driving member 57 having a substantially L-shaped configuration as viewed from the side is provided between the first swinging member 53 and the channel member 46, and is rotatably supported on the fixed shaft 50. The swinging/driving member 57 has a driving arm 58 formed at its front end with an arcuate sector gear. This sector gear meshes with a driving gear 59 fixed to the output shaft of the stepping motor 49. Reference numeral 108 designates a sensor for deciding an original position of the swinging/driving member 57. The swing/driving member 57 has a swinging arm 60 connected to the first swinging member 53 by a screw 61. Accordingly, when the stepping motor 49 is driven, the swinging/driving member 57 and the first swinging member 53 are rotated together about the fixed shaft 50.

Figure 7:
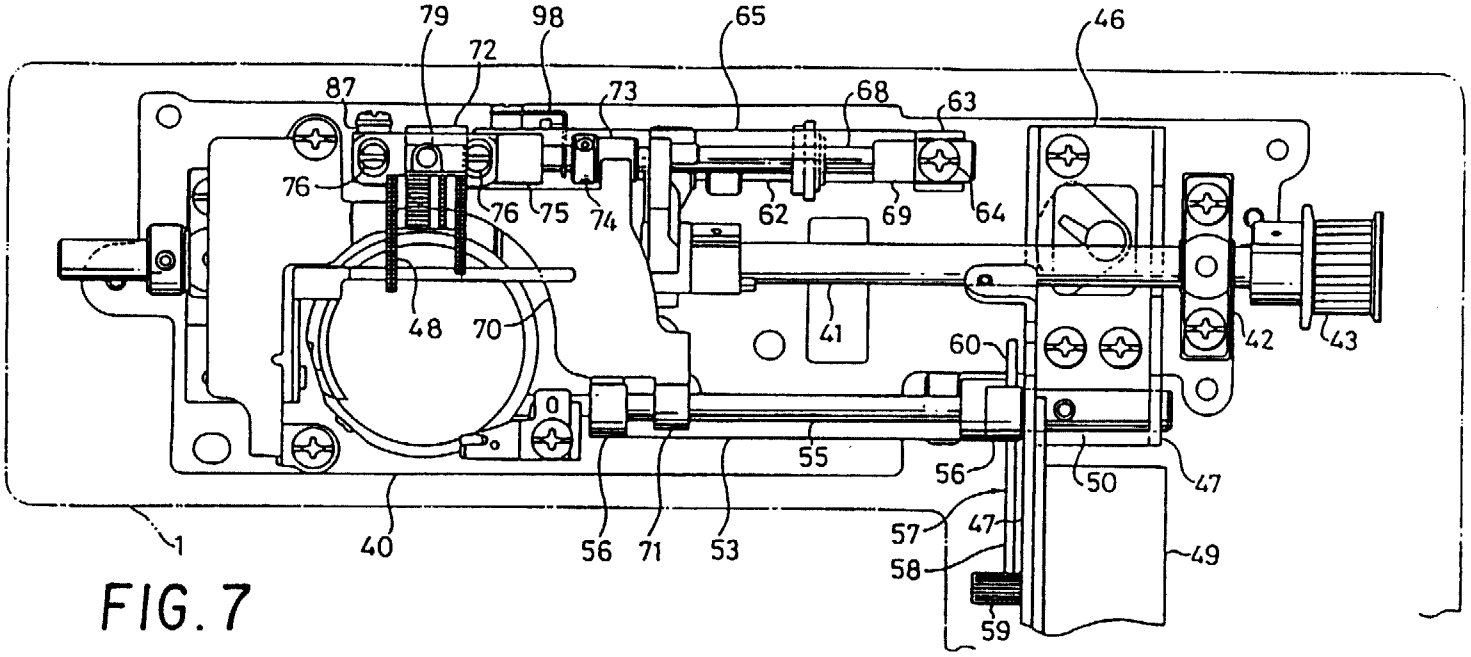
FIG. 7 is a top plan view of an internal mechanism incorporated in a bed section of the sewing machine shown in FIG. 1.
Figure 8:
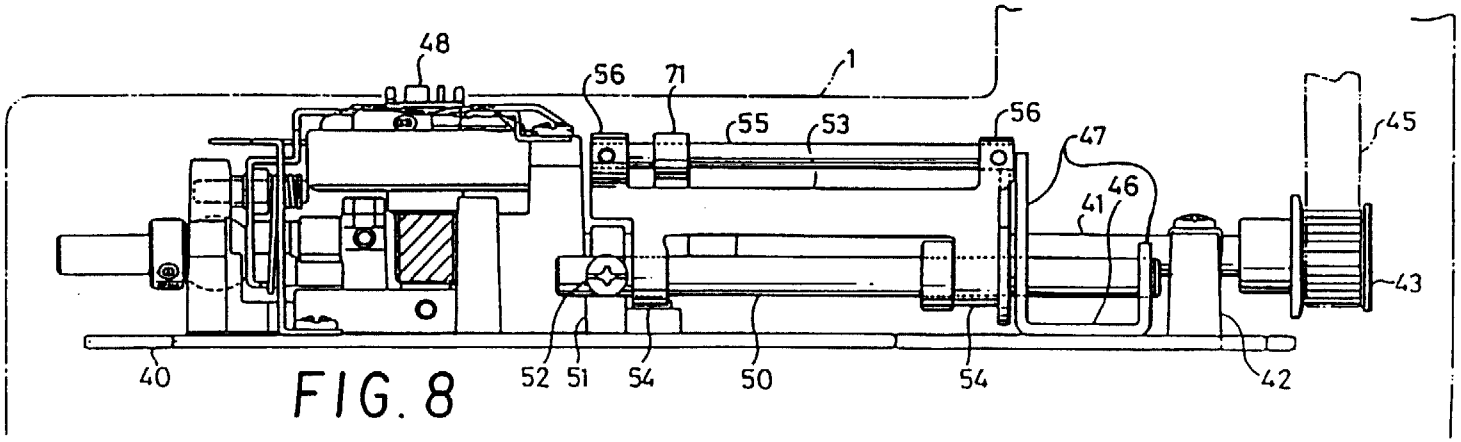
FIG. 8 is a front elevational view of the internal mechanism shown in FIG. 7.
Figure 9:
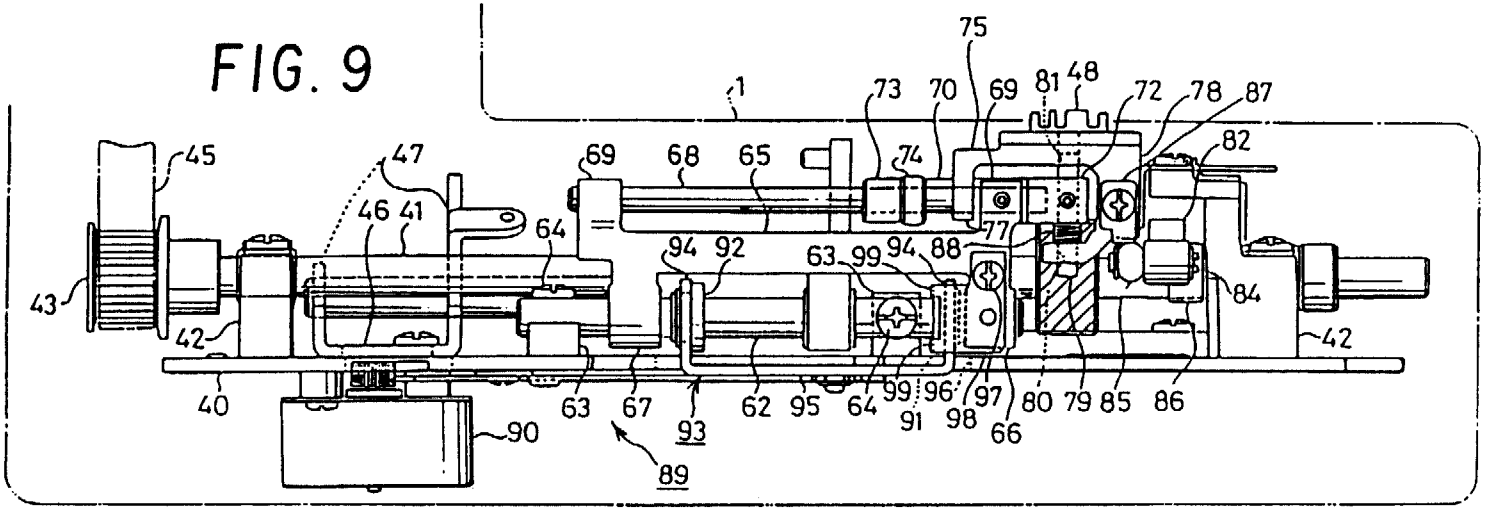
FIG. 9 is a rear elevational view of the internal mechanism shown in FIG. 7.

Referring to FIG. 9, a fixed shaft 62 is disposed in the vicinity of the rear end of the base plate 40, and extends in the longitudinal direction of the base plate 40 at the longitudinally central portion thereof. The fixed shaft 62 is fixed by a screw 64 to a pair of supports 63 fixed to the base plate 40. A second swinging member 65 is formed at its lower portion with a pair of pivotal portions 66 and 67, and the fixed shaft 62 is inserted through the pivotal portions 66 and 67. Thus, the second swinging member 65 is swingably supported at its pivotal portions 66 and 67 to the fixed shaft 62. The second swinging member 65 is further formed at its upper portion with a pair of supporting portions 69, and a shaft 68 disposed in parallel to the fixed shaft 62 is fixed to the supporting portions 69. A connecting member 70 for transmitting a swinging movement of the first swinging member 53 to the second swinging member 65 is formed with three pivotal portions 71, 72 and 73 (FIG. 7). The shaft 55 is inserted through the pivotal portion 71; the shaft 68 is inserted through the pivotal portion 73; and a left end portion of the shaft 68 is fitted in the pivotal portion 72. Accordingly, when the first swinging member 53 is swung, the connecting member 70 is moved in the transverse direction of the base plate 40, thereby swinging the second swinging member 65 through the shaft 68. In order to prevent axial movement of the connecting member 70 relative to the shaft 68 a stopper ring 74 abuts against a left end surface of the pivotal portion 73, and is fixed to the shaft 68.

Referring to FIG. 9, the feed dog 48 is fixed to a feed bar 75 by a pair of screws 76. The feed bar 75 is formed at its left end portion with a first let 77 extending downwardly, and the first leg 77 is formed at its lower end with a U-shaped recess. This U-shaped recess is engaged with the shaft 68 to thereby prevent rotation of the feed bar 75 about a vertical axis. The feed bar 75 is further formed at its right end portion with a second leg 78 extending downwardly and bent horizontally. The second leg 78 is formed at its lower end portion with an insert hole 80 for inserting a vertical driving pin 79. The feed bar 75 and the feed dog 48 are also formed with insert holes 81 adapted to insert the driving pin 79 in opposition to the insert hole 80. The vertical driving pin 79 is inserted through the pivotal portion 72, and is fixed thereto by a screw under the condition where the pin 79 is engaged with the insert holes 80 and 81. Accordingly, when the second swinging member 65 is swung frontward and rearward, the feed dog 48 is moved frontward and rearward through the driving pin 79 and the feed bar 75.

A swinging lever 82 extending in the transverse direction of the base plate 40 is located just on the left side of the feed bar 75 (FIG. 11). The swinging lever 82 is pivotably supported at its front end by a pin 83 to the base plate 40, and a substantially spherical vertical moving member 85 is mounted through a pin 84 to the rear end of the swinging lever 82. An eccentric cam 86 is fixed to the lower shaft 41 at a position opposed to the swinging lever 82, so that the swinging lever 82 is vertically swung about the pin 83 in accordance with a cam profile of the eccentric cam 86 by the rotation of the lower shaft 41. A mounting plate 87 having an L-shaped configuration as viewed from the side is fixed at its vertical portion to the second leg 78 of the feed bar 75 by a screw, and a horizontal portion of the mounting plate 87 is abuttable against the upper surface of the vertical moving member 85. A compression spring 88 is mounted around the driving pin 79 between the pivotal portion 72 and the second leg 78, so as to normally bias the mounting plate 87 against the vertical moving member 85. Accordingly, when the vertical moving member 85 is vertically moved through the swinging lever 82 by the rotation of the lower shaft 41, the feed bar 75 and the feed dog 48 are vertically moved through the mounting plate 87. At the timing when the feed dog 48 is lifted and lowered, the forward/reverse feed stepping motor 49 is driven to forwardly and reversely move the feed dog 48.

A lateral feed driving device 89 will now be described with reference to FIGS. 7 to 11.

Figure 10:
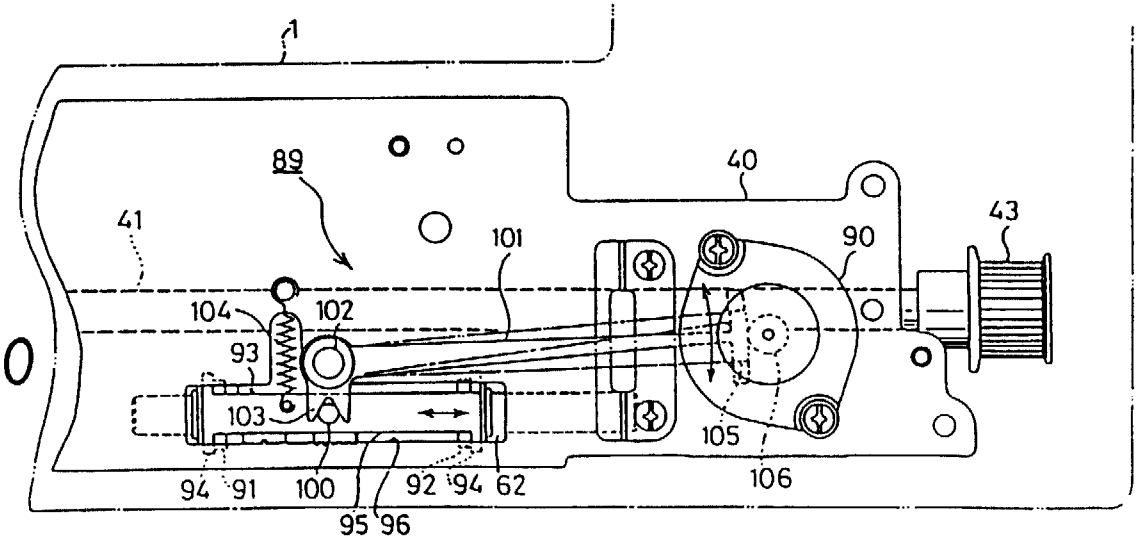
FIG. 10 is a bottom plan view of part of the internal mechanism shown in FIG. 7.

A pair of ring-like slide members 91 and 92 are slidably mounted on the fixed shaft 62, and right and left supporting portions 94 of a movable member 93 having a substantially U-shaped configuration as viewed in elevation are rotatably supported on the slide members 91 and 92. A movable portion 95 of the movable member 93 is located in a rectangular cutout 96 formed through the base plate 40, and the lower end surface of the movable portion 95 projects slightly downwardly from the base plate 40. A left end of the slide member 91 abuts against a right end of the pivotal portion 66 of the second swinging member 65, and a forked portion 99 of a mounting plate 98 fixed to the pivotal portion 66 by a screw 97 is bent frontward at a right end of the slide member 91. Thus, the pivotal portion 66 is integrally connected with the slide member 91. Accordingly, the second swinging member 65 is movable through the pivotal portion 66 in the axial direction of the fixed shaft 62 in synchronism with the movable member 93. On the other hand, as shown in FIG. 10, a pin 100 is fixed to the lower surface of the movable member 93 at the longitudinally central position thereof, and a swinging arm 101 is provided so as to move the pin 100 in the longitudinal direction of the movable member 93.

The swinging arm 101 is pivotably supported at its left end portion by a pin 102 to the base plate 40, and the left end portion is formed with a forked output portion 103 projecting rearwardly. The pin 100 is engaged with the forked output portion 103 by a biasing force of a tension spring 104. The swinging arm 101 is formed at its right end with an arcuate enlarged portion 105 having a gear. This gear meshes with a driving gear 106 fixed to the output shaft of a lateral feed stepping motor 90 fixed to the base plate 40. Accordingly, when the swinging arm 101 is rotated about the pin 102 through the driving gear 106 by the lateral feed stepping motor 90, the output portion 103 is swung. As a result, the pin 100, that is, the movable member 93 is moved right and left, and the feed dog 48 is accordingly moved right and left through the second swinging member 65, the connecting member 70 and the driving pin 79. Such a lateral movement of the feed dog 48 causes lateral feed of the work fabric W.

Figure 12:
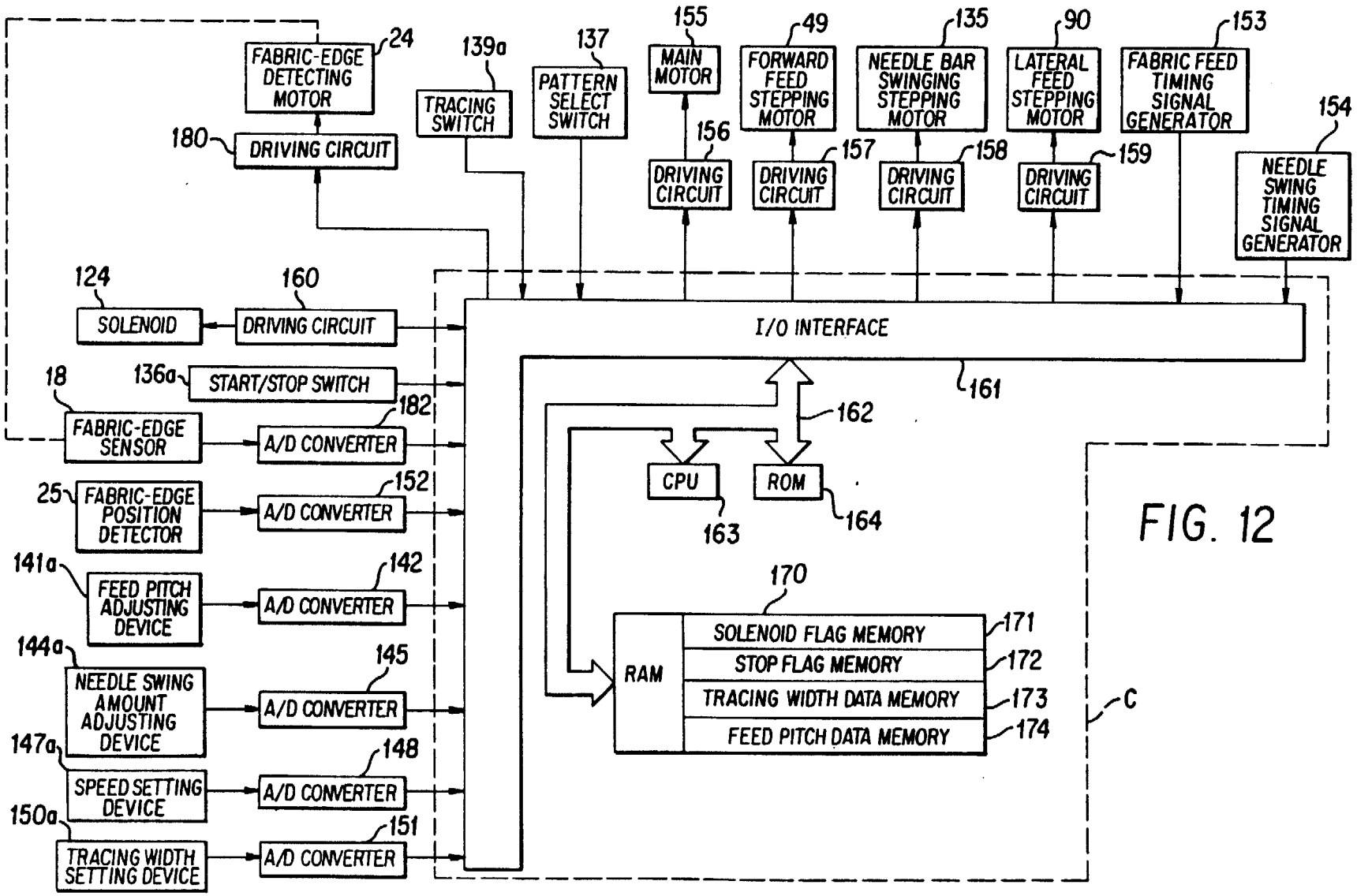
FIG. 12 is a block diagram of a control system of the sewing machine of FIG. 1.

There will now be described a control system of the sewing machine M with reference to FIG. 12. A control device C includes an I/O interface 161 connected through driving circuits 156, 157, 158, 159, 160 and 180 to the main motor 155, the forward feed stepping motor 49, the stepping motor 135 for swinging the needle bar, the lateral feed stepping motor 90, the solenoid 124 and the fabric-edge detecting motor 24, respectively. The I/O interface 161 is also connected through A/D converters 142, 145, 148, 151, 152 and 182 to a feed pitch adjusting device 141*a*, a needle swing amount adjusting device 144*a*, a speed setting device 147*a*, a tracing width setting device 150*a*, the fabric-edge position detector 25 and the fabric-edge sensor 18, respectively. Further, the I/O interface 161 is also connected to a start-stop switch 136*a*, the pattern select switch 137, a tracing switch 139*a*, a fabric feed timing signal generator 153 and, a needle swing timing signal generator 154.

The control device C is constituted from a CPU (central processing unit) 163, and the I/O interface 161, an ROM 164 and an RAM 170 all connected to the CPU 163 by way of a bus 162 such as a data bus.

The ROM 164 has the following data and programs stored in advance therein.

(1) Stitch pattern data which are needle position data for individual sewing operations stored for each of a large number of stitch patterns of characters, symbols, marks and so forth in a corresponding relationship to respective pattern numbers.

(2) A control program for controlling drive of the main motor 155 in response to a preset speed signal received from the speed setting device 147*a* and a starting signal and a stopping signal received from the start/stop switch 136*a*.

(3) Another control program for controlling, in accordance with selected pattern data, the needle bar swinging stepping motor 135 at a needle swinging timing and controlling the forward feed stepping motor 49 and the lateral feed stepping motor 90 at a feeding timing.

(4) A fabric-edge tracing control program which is started in response to a tracing signal from the tracing switch 139*a*.

The last-mentioned fabric-edge tracing control program involves the following data and subroutines.

(i) A needle bar controlling subroutine for fixing the needle bar 9 at the center of a swinging range of the needle bar 9 without permitting swinging motion of the needle bar 9.

(ii) An upper limit value $P_1$ and a lower limit value $P_2$ corresponding respectively to an upper limit and a lower limit of a range of preset threshold level of received light amount. The fabric-edge sensor 18 is moved to follow up an edge Wa of the work fabric W based on the upper and lower limit value $P_1$, $P_2$. The difference between the upper limit value $P_1$ and the lower limit value $P_2$ is very small.

(iii) A fabric-edge detecting subroutine for providing an instruction of an amount and a direction by and in which the fabric-edge detecting motor 24 is to be driven so that detection data Ds corresponding to a detection voltage Vs from the fabric-edge sensor 18 may satisfy a relational expression $P_2 \leqq Ds \leqq P_1$.

Figure 13:
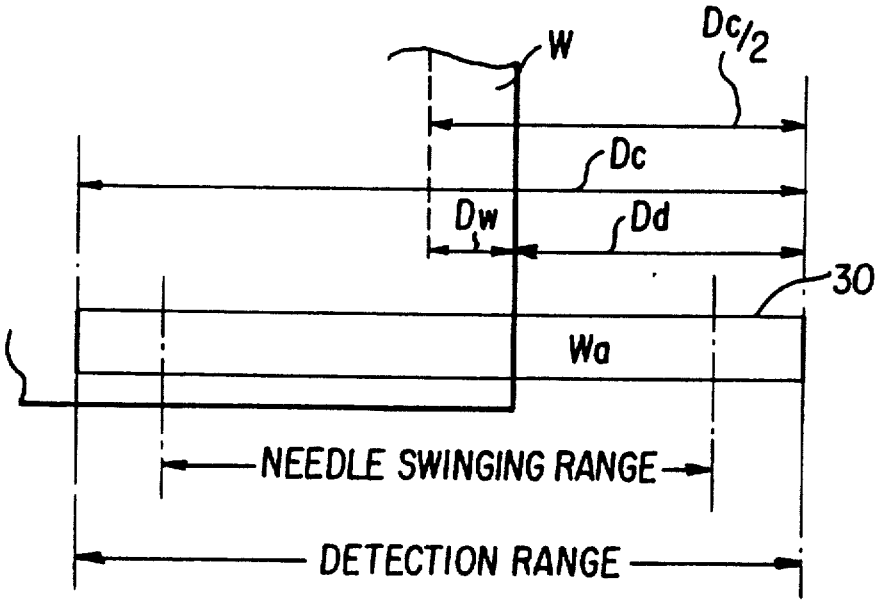
FIG. 13 is a diagrammatic representation illustrating needle location control in tracing sewing.

(iv) Detection range data Dc in accordance with a detection range corresponding to an entire width of the reflecting surface 30 as shown in FIG. 13.

(v) A calculation subroutine for calculating tracing width detection data Sw in accordance with $Sw = Dc/2 - Dd$ from the equation of $Dc/2 = Dw + Dd$, wherein Dw is tracing width set data corresponding to a tracing width voltage Vw received from the tracing width setting device 150*a*, and Dd is fabric-edge position data corresponding to a fabric-edge position voltage Vd received from the fabric-edge position detector 25.

(vi) A maximum lateral feed pitch data A (for example, 0.6 mm) of the lateral feed stepping motor 90.

The RAM 170 has provided therein a solenoid flag memory 171 for storing therein a solenoid flag IF which is set when the solenoid 124 is energized, a stop flag memory 172 for storing therein a stop flag SF which is set when the main motor 155 is stopped, a tracing width data memory 173 for storing tracing width set data Dw therein, a feed pitch data memory 174 for storing feeding pitch data B for the forward feed driving device therein, and various memories for temporarily storing therein results of calculations executed by the CPU 163.

Figure 14A:
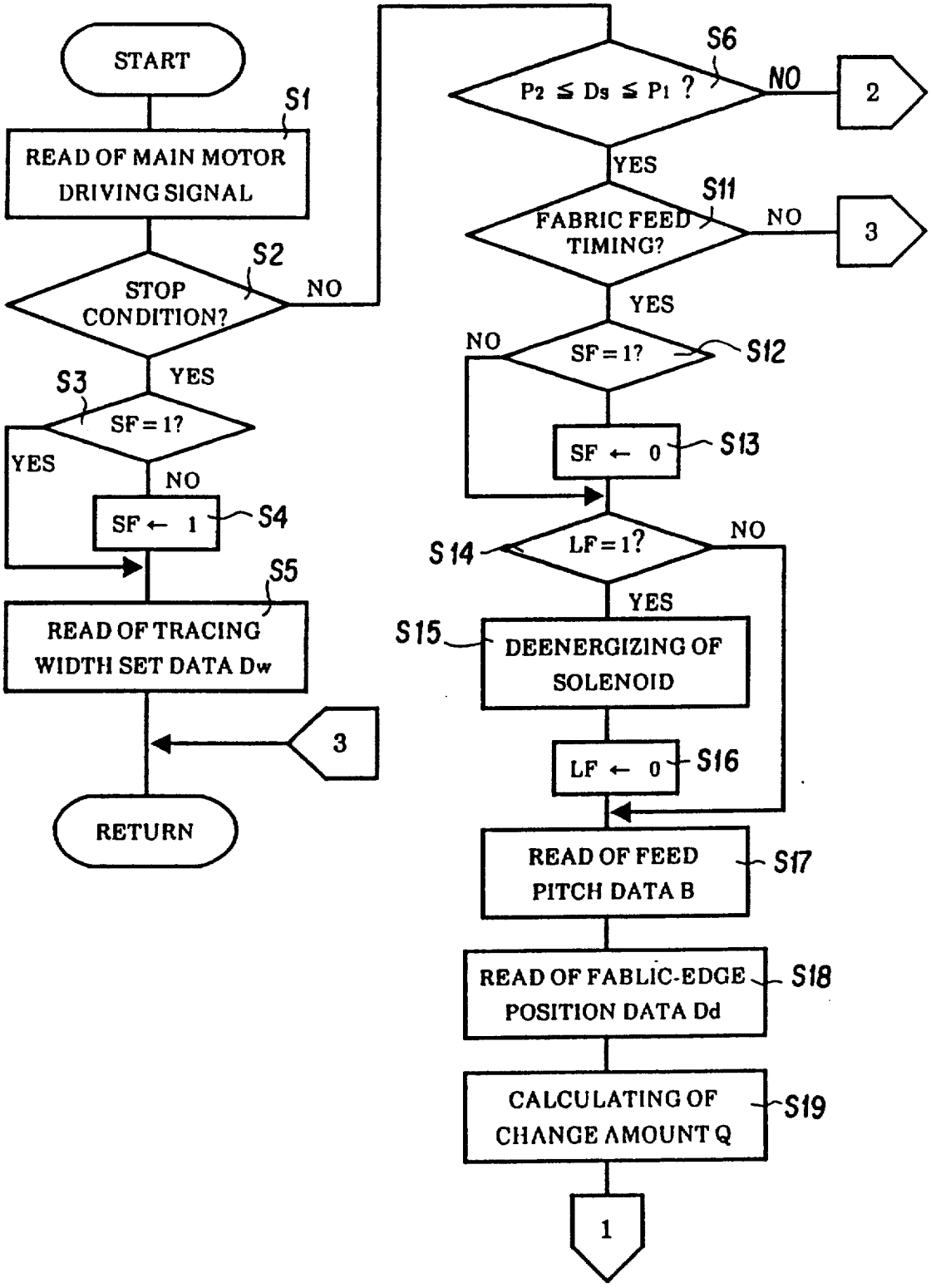
FIGS. 14(*a*) and 14(*b*) are schematic flow charts illustrating a fabric-edge tracing control routine.
Figure 14B:
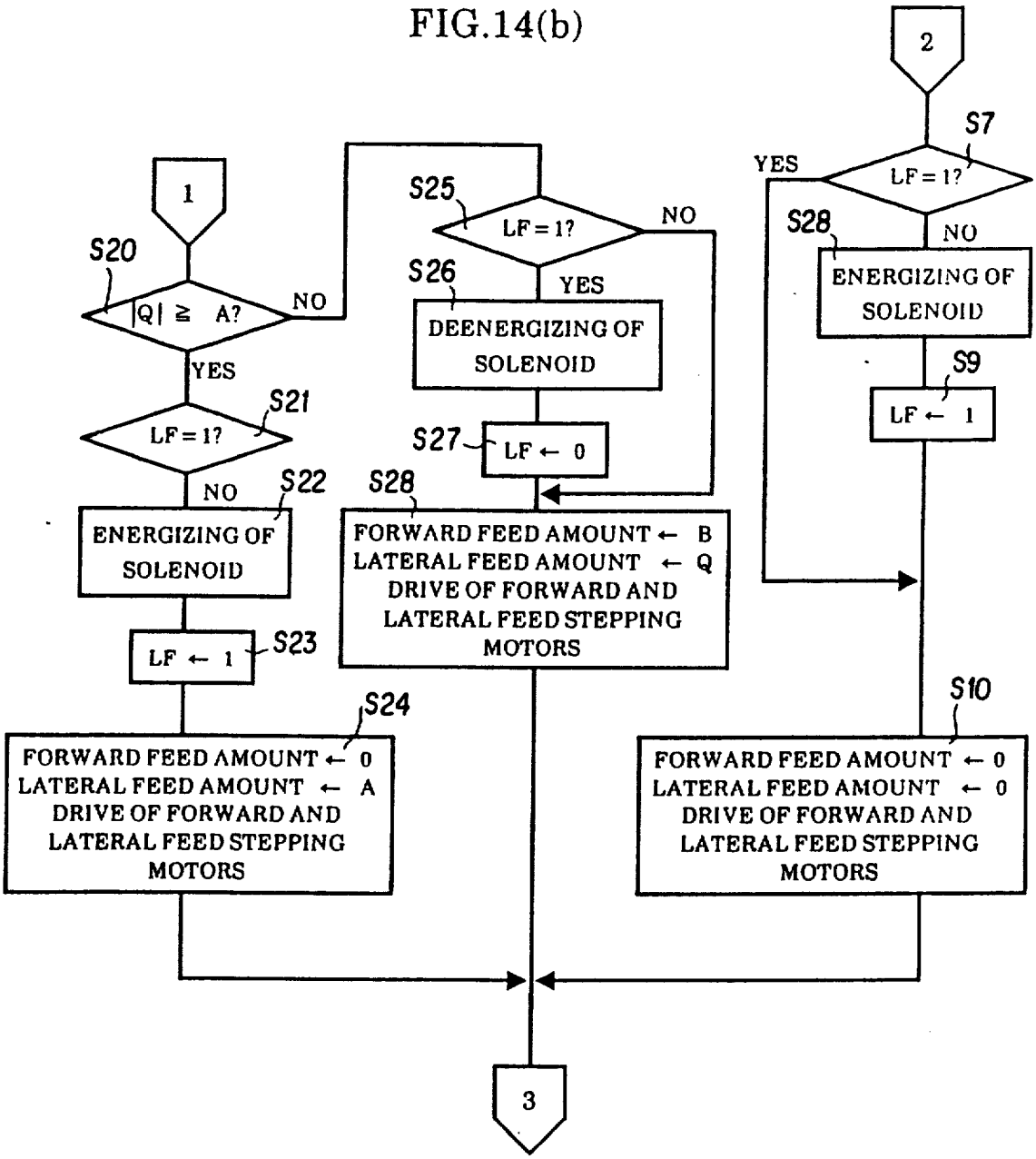

Subsequently, a routine of fabric-edge tracing control executed by the controlling device C of the sewing machine M will be described with reference to a flow chart of FIG. 14(*a*) and 14(*b*). It is to be noted that reference character Si (i = 1, 2, 3, . . . in FIGS. 14(*a*) and 14(*b*) denotes a step number. The control is executed for each fraction of time, wherein forward feeding and lateral feeding of the work fabric W are executed at a fabric feed timing. It is to be noted that, when the present control is started, straight stitch is mandatorily selected.

If the tracing switch 139*a* is changed over to a tracing side, then the fabric-edge sensor 18 is controlled so as to follow up the edge Wa of the work fabric W in accordance with the fabric-edge detecting subroutine and fabric-edge tracing control is started. In case the sewing machine M is in a stop condition in accordance with a driving signal outputted to the main motor 155 (S1 to S2), the stop flag SF is set (S3 to S4). Then, tracing width set data Dw is read and stored into the tracing width data memory 713 (S5). Then, the program is returned.

After starting of tracing sewing, it is judged whether or not detection data Ds from the fabric-edge sensor 18 is equal to or smaller than the upper limit value $P_1$ stored in the ROM 164 and equal to or greater than the lower limit value $P_2$ stored in the ROM 164 (S6). In short, it is judged whether or not the fabric-edge sensor 18 accurately follows up the edge Wa of the work fabric W. When, for example, tracing sewing is started, after the work fabric W is turned in order to perform tracing sewing at a corner portion of the work fabric W or after the work fabric W is moved to a great extent in a lateral direction or the like, the relative position between the edge Wa of the work fabric W and the fabric-edge sensor 18 varies to a great extent, so that, the fabric-edge detecting motor 24 is driven to move the fabric-edge sensor 18 toward the fabric edge Wa. When the fabric-edge sensor 18 is moving, the judgment at step S6 is "No" and consequently, the solenoid 124 is energized and the solenoid flag LF is set (S7 to S9). Then, the forward feed stepping motor 49 and the lateral feed stepping motor 90 are driven so that the forward feed amount and the lateral feed amount may be both equal to "0", respectively (S10). Then, the program is returned. As a result, the forward feeding operation and the lateral feeding operation for the work fabric W by the feed dog 48 are interrupted. Meanwhile the slide plate 128 is moved leftwardly and thereafter held at a position at which it can engage with the clutch plate 117. Then, when the phase of the main shaft 44 becomes substantially equal to 0 degree and the needle 10 reaches its uppermost position, the slide plate 128 and the clutch plate 117 are engaged with each other so that reciprocation of the needle 10 and the thread take-up lever 122 is stopped. After then, the steps S6 to S10 described above are repeated to maintain interruption of tracing sewing until the detection data Ds from the fabric-edge sensor 18 satisfies the relational expression $P_2 \leqq Ds \leqq P_1$ and consequently the judgment at step S6 is changed to "Yes".

Then, after the fabric-edge sensor 18 detects the edge Wa of the work fabric W and the detection data Ds from the fabric-edge sensor 18 satisfies the relational expression $P_2 \leqq Ds \leqq P_1$, it is judged whether or not a fabric feed timing signal is generated from the fabric feed timing signal generator 153 (S6 and S11). If the fabric feed timing signal is generated, then the stop flag SF is reset (S12 to S13), and in case the solenoid 124 is in an energized condition the solenoid 124 is de-energized and the solenoid flag LF is reset (S14 to S16). Then, feed amount data B is read in accordance with a feed pitch adjusting signal from the feed pitch adjusting device 141*a* and stored into the feed pitch data memory 174 (S17), and then fabric-edge position data Dd is read from the fabric-edge position detector 25 (S18). Then, tracing width detection data Sw is calculated from detection range data Dc stored in the ROM 164 and fabric-edge position data Dd stored in the ROM 164, and then a difference between the tracing width detection data Sw and the tracing width set data Dw set by the tracing width setting device 150*a*, that is, a change amount Q in tracing width, is calculated (S19). After then, when the change amount Q is equal to or greater than the maximum lateral feed pitch data A stored in the ROM 164 (S20), the solenoid 124 is energized (S21 to S23). Then, the forward feed stepping motor 49 and the lateral feed stepping motor 90 are driven so that the forward feed amount may be equal to "0" and the lateral feed amount may be equal to the maximum lateral feed pitch data A, respectively (S24). Then, the program is returned. After then, each time the fabric feed timing signal is generated from the fabric feed timing signal generator 153, the steps S20 to S24 described above are repeated until the change amount Q in tracing width becomes smaller than the maximum lateral feed pitch data A.

If the change amount Q becomes smaller than the maximum lateral feeding pitch data A, then the judgment at step S20 is changed into "No", and the solenoid 124 is de-energized (S25 to S27). Consequently, the slide plate 128 is returned to its inoperative position to disengage the slide plate 128 from the clutch plate 117. Then, the forward feed stepping motor 49 and the lateral feed stepping motor 90 are driven so that the feeding amount may be equal to the feed pitch data B stored in the feed pitch data memory 174 and the lateral feed amount may be equal to the change amount Q, respectively (S28). Then, the program is returned. Then, while a fabric feeding operation is being performed, the recess 112 of the set collar 111 and the projection 118 of the clutch plate 117 are engaged with each other to start reciprocation of the needle 10 and the thread take-up lever 122 to start tracing sewing. Also in case the judgment at step S6 is "No" while the steps S20 to S28 described above are being executed to perform lateral feeding of the work fabric W, tracing sewing is temporarily interrupted by the steps S7 to S10.

Figure 15:
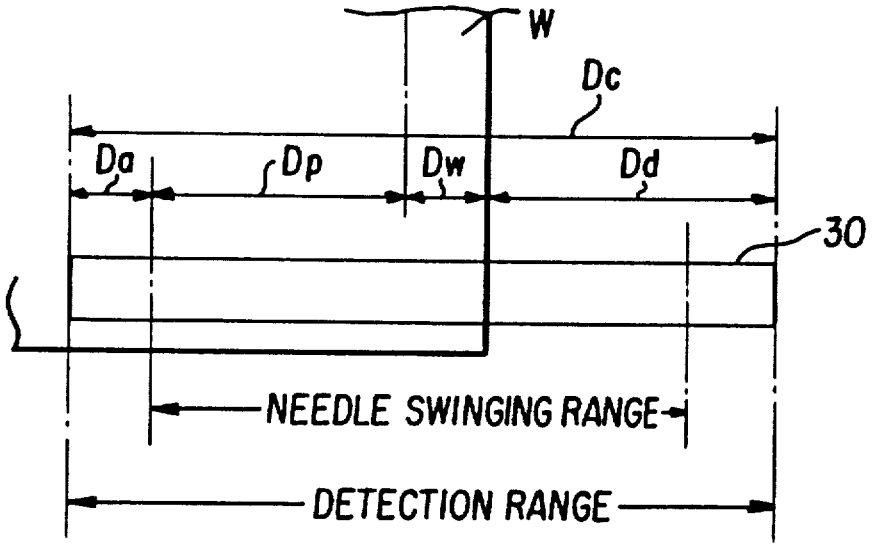
FIG. 15 is a diagrammatic representation illustrating needle location control where the present invention is applied to sewing machine which is not equipped with a lateral feeding driving device.
Figure 16A:
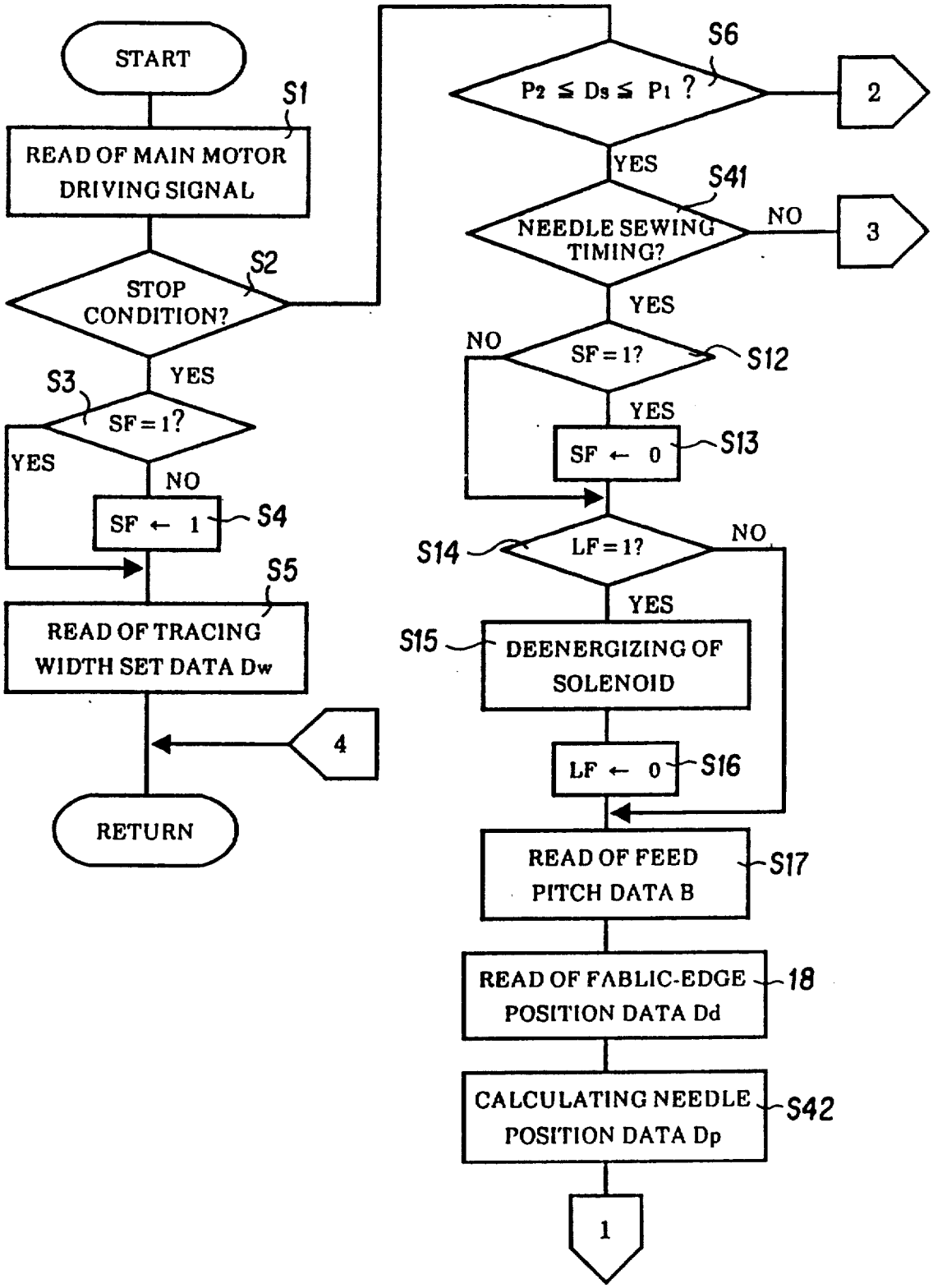
FIGS. 16(*a*) and 16(*b*) are flow charts of a modified fabric-edge tracing control routine which achieves the needle location control illustrated in FIG. 15.
Figure 16B:
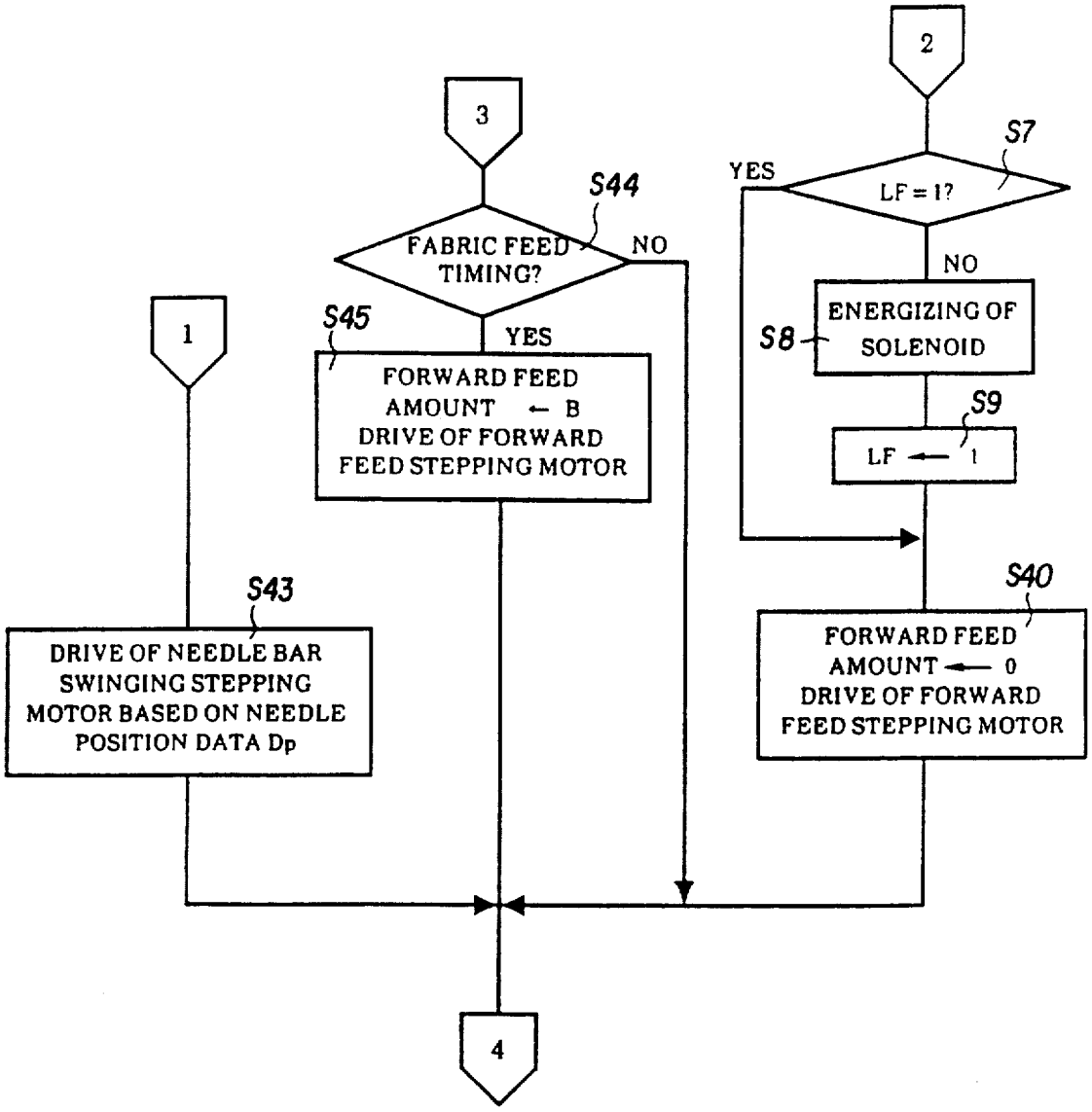

Here, it is possible to apply the present invention to an electronically controlled zigzag sewing machine which is equipped with no lateral feeding driving device. In this instance, reference data Da corresponding to the difference between a detection range and a range of swinging motion to the needle 10 shown in FIG. 15 is stored in the ROM 164 in advance. Then, a distance from a left end of the range of swinging motion of the needle 10 to a position at which a stitch is to be formed, that is, needle position data Dp may be calculated in accordance with an operation expression $Dp = Dc - Dd - Da - Dw$. In particulate, the fabric-edge tracing control described hereinabove with reference to FIGS. 14(*a*) and 14(*b*) is modified such that the steps S10 and S11 are replaced by steps S40 and S41 respectively, and the steps S19 to S28 are replaced by steps S42 to S45, as shown in FIGS. 16(*a*), 16(*b*). According to the modified fabric-edge tracing control, in case the detection data Ds does not satisfy the relational expression $P_2 \leqq Ds \leqq P_1$, the forward feed stepping motor 49 is driven after execution of the steps S7 to S9 so that the feeding amount may be equal to "0" (S40), and reciprocation of needle 10 and forward feeding of the work fabric W are stopped to interrupt the tracing sewing. But, at a needle swinging timing after a condition is reached wherein the detection data Ds satisfies the relational expression $P_2 \leqq Ds \leqq P_1$ (S41), the needle bar swinging stepping motor 135 is driven, after execution of the steps S12 to S18, so that the needle position may coincide with the needle position data Dp calculated in accordance with the operation expression given hereinabove (S42 to S43). Further, at a fabric feed timing (S44), the forward feed stepping motor 49 is driven so that the forward feeding amount may be equal to the feed pitch data B (S45).

Further, it is also possible to apply the present invention to an electronically controlled zigzag sewing machine wherein the fabric-edge sensor 18 is provided on the needle bar 9. In this instance, in case the detection data Ds does not satisfy the relational expression $P_2 \leqq Ds \leqq P_1$ when the needle bar 10 is lifted above the throat plate 28, the solenoid 124 is energized and the forward feed amount is set to "0" to interrupt tracing sewing.

As described so far, since reciprocation of the needle bar 9 and feeding of the work fabric W are stopped to interrupt tracing sewing until the fabric-edge sensor 18 accurately detects the edge Wa of the work fabric W, stitches are formed normally tracing the fabric edge Wa accurately, and consequently, the quality of tracing sewing can be improved significantly.

What is claimed is:

1. An edge tracing sewing machine comprising:

a reciprocable needle bar having a needle at a lower end thereof;

feeding means for feeding a workpiece in a sewing direction;

relative position changing means for changing relative position between the needle and the workpiece in a lateral direction perpendicular to the sewing direction;

tracing width setting means for setting a tracing width from the edge of the workpiece to the needle in the lateral direction;

edge detecting means for detecting the edge of the workpiece in the lateral direction;

relative position control means for controlling said relative position changing means based on the tracing width set by said tracing width setting means and the detection of the edge of the workpiece by said edge detecting means; and interrupting means for stopping a reciprocation of said needle bar and a feeding operation of said feeding means when said edge detection means does not detect the edge of the workpiece.

2. An edge tracing sewing machine as in claim 1, wherein the relative position changing means includes a lateral feeding means, and wherein the interrupting means stops the lateral feeding means when said edge detection means does not detect the edge of the workpiece.

3. An edge tracing sewing machine comprising:

a reciprocable needle bar having a needle at a lower end thereof;

feeding means for feeding a workpiece in a sewing direction;

relative position changing means for changing relative position between the needle and the workpiece in a lateral direction perpendicular to the sewing direction;

tracing width setting means for setting a tracing width from the edge of the workpiece to the needle in the lateral direction;

edge detecting means movable in the lateral direction for detecting an edge of the workpiece;

first control means for moving said edge detecting means in the lateral direction to a position to detect the edge of the workpiece;

position detecting means for detecting a position of said edge detecting means;

second control means for controlling said relative position changing means based on the tracing width set by said tracing width setting means and the position of said edge detecting means detected by said position detecting means; and third control means for stopping a reciprocation of said needle bar and a feeding operation of said feeding means while said edge detecting means is moved by said first control means.

4. The edge tracing sewing machine according to claim 3, wherein said relative position changing means comprises lateral feeding means for feeding the workpiece in the lateral direction perpendicular to the sewing direction.

5. The edge tracing sewing machine as in claim 4, wherein the third control means includes means for stopping the lateral feeding means while said edge detecting means is moved by said first control means.

6. The edge tracing sewing machine according to claim 3, wherein said relative position changing means comprises needle swinging means for swinging the needle in the lateral direction perpendicular to the sewing direction.

7. The edge tracing sewing machine as in claim 3, wherein the first control means includes means for determining the positional relationship:

$$P_2 \leqq Ds \leqq P_1$$

wherein $P_1$ is an upper limit of a relative position between the edge of the workpiece and the position of the edge detecting means, $P_2$ is a lower limit of a relative position between the edge of the workpiece and the position of the edge detecting means, and $D_s$ is a positional value detected by said edge detecting means.

8. An edge tracing sewing machine comprising:

a main shaft rotated by a main motor;

a needle bar having a needle at a lower end thereof;

a needle bar driving mechanism driven by said main shaft for reciprocating said needle bar;

clutch means for transmitting rotation of the main shaft to the needle bar driving mechanism;

feeding means for feeding a workpiece in a sewing direction;

relative position changing means for changing the relative position between the needle and the workpiece in a lateral direction perpendicular to the sewing direction;

edge detecting means movable in the lateral direction for detecting an edge of the workpiece, including a light emitting element and a light receiving element;

first control means for moving said edge detecting means in the lateral direction based on an amount of light received by the light receiving element of said edge detecting means so as to make said edge detecting means follow the edge of the workpiece;

position detecting means for detecting a position of said edge detecting means and generating a position signal;

second control means for controlling said relative position changing means based on the tracing width set by said tracing width setting means and the position signal generated by said position detecting means;

third control means for disengaging the clutch means and causing said feeding means to stop feeding of the workpiece when the amount of light received by the light receiving element of said edge detecting means is different from a predetermined range of values corresponding to detection of the edge of the workpiece.

9. The edge tracing sewing machine as in claim 8, wherein the feeding means includes a stepping motor and wherein the third control means includes means for stopping the stepping motor when the amount of light received by said receiving means is different from said predetermined range of values.

10. The edge tracing sewing machine as in claim 8, wherein the first control means includes a stepping motor for driving the edge detecting means.

11. The edge tracing sewing machine as in claim 8, wherein the first control means includes means for determining a relationship between a value representative of an amount of light received by the light receiving element and a predetermined range of values related to the position of the edge of the workpiece.

* * * * *